US009334613B2

(12) United States Patent
Erdmann et al.

(10) Patent No.: US 9,334,613 B2
(45) Date of Patent: May 10, 2016

(54) VIBRATION EXCITER FOR A VIBRATION COMPACTOR AND CONSTRUCTION MACHINE HAVING SUCH A VIBRATION EXCITER

(71) Applicant: BOMAG GmbH, Boppard (DE)

(72) Inventors: Peter Erdmann, Emmelshausen (DE); Niels Laugwitz, Lahnstein (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/558,860

(22) Filed: Dec. 3, 2014

(65) Prior Publication Data

US 2015/0152606 A1 Jun. 4, 2015

(30) Foreign Application Priority Data

Dec. 3, 2013 (DE) ..... 10 2013 020 690

(51) Int. Cl.

| | |
|---|---|
| ***E01C 19/00*** | (2006.01) |
| ***E01C 19/28*** | (2006.01) |
| ***E01C 19/35*** | (2006.01) |
| ***E01C 19/38*** | (2006.01) |
| ***B06B 1/16*** | (2006.01) |
| ***E02D 3/026*** | (2006.01) |

(52) U.S. Cl.

CPC ..... *E01C 19/286* (2013.01); *B06B 1/161* (2013.01); *E01C 19/282* (2013.01); *E01C 19/283* (2013.01); *E01C 19/35* (2013.01); *E01C 19/38* (2013.01); *E02D 3/026* (2013.01)

(58) Field of Classification Search

CPC ..... B06B 1/161; E01C 19/282; E01C 19/286; E01C 19/35; E01C 19/38; E01C 19/283; E02D 3/026

USPC ..... 404/113, 114, 117, 118, 122; 74/86, 87

See application file for complete search history.

(56) References Cited

U.S. PATENT DOCUMENTS

| | | | | |
|---|---|---|---|---|
| 2,386,843 | A * | 10/1945 | Davis | 404/113 |
| 2,766,629 | A * | 10/1956 | Booth | 74/61 |
| 2,952,193 | A * | 9/1960 | Converse | E01C 19/38 404/113 |
| 8,021,079 | B1 * | 9/2011 | Rackham | E01C 19/34 404/133.05 |

(Continued)

FOREIGN PATENT DOCUMENTS

| | | |
|---|---|---|
| CN | 101864772 B | 11/2012 |
| EP | 0 092 014 A1 | 10/1983 |

(Continued)

OTHER PUBLICATIONS

Espacenet, English Machine Translation of EP0092014A1, published Oct. 26, 1983, retrieved from http://worldwide.espacenet.com on Nov. 30, 2014 (11 pages).

Espacenet, English Machine Translation of Abstract of EP0951949A1, published Oct. 27, 1999, retrieved from http://worldwide.espacenet.com on Nov. 30, 2014 (2 pages).

(Continued)

*Primary Examiner* — Raymond W Addie

(74) *Attorney, Agent, or Firm* — Wood, Herron & Evans, LLP

(57) ABSTRACT

A soil compaction machine, in particular, a vibration compactor, is provided which comprises a vibration exciter for generating different kinds of exciter vibration having a first and a second imbalance shaft, which are arranged in parallel to one another. Each imbalance shaft is driven via a separate motor, so that the rotational velocity, the rotational direction, and the phase relation of each of the imbalance shafts can be changed separately.

9 Claims, 6 Drawing Sheets

(56) References Cited

U.S. PATENT DOCUMENTS

| | | | | |
|---|---|---|---|---|
| 8,246,271 | B2 * | 8/2012 | Verhoff | E01C 19/268 404/117 |
| 2007/0166103 | A1 * | 7/2007 | Paske | 404/117 |
| 2011/0013982 | A1 * | 1/2011 | Prohaska | E02D 3/046 404/72 |
| 2014/0305234 | A1 * | 10/2014 | Kleibl et al. | 74/61 |

FOREIGN PATENT DOCUMENTS

| | | | |
|---|---|---|---|
| EP | 0 704 575 | B1 | 4/1996 |
| EP | 0 951 949 | A1 | 10/1999 |
| EP | 2 743 402 | A2 | 6/2014 |
| WO | 2008/000535 | A1 | 1/2008 |

OTHER PUBLICATIONS

Espacenet, English Machine Translation of WO2008000535A1, published Jan. 3, 2008, retrieved from http://worldwide.espacenet.com on Nov. 30, 2014 (12 pages).

Espacenet, English Machine Translation of EP2743402A2, published Jun. 18, 2014, retrieved from http://worldwide.espacenet.com on Nov. 30, 2014 (19 pages).

German Patent Office, Search Report, Application No. 10 2013 020 690.1, mailed Aug. 4, 2014 (7 pages).

Espacenet, English Machine Translation of Abstract for CN101864772A, published Oct. 20, 2010, retrieved from http://worldwide.espacenet.com on May 7, 2015 (2 pages).

European Patent Office, European Search Report, Application No. 14004040.3, mailed May 6, 2015 (8 pages).

* cited by examiner

VIBRATION EXCITER FOR A VIBRATION COMPACTOR AND CONSTRUCTION MACHINE HAVING SUCH A VIBRATION EXCITER

CROSS-REFERENCE TO RELATED APPLICATIONS

The present application claims priority under 35 U.S.C. §119 of German Patent Application No. 10 2013 020 690.1, filed Dec. 3, 2013, the disclosure of which is hereby incorporated herein by reference in its entirety.

FIELD OF THE INVENTION

The present invention relates to a soil compaction machine, in particular, a vibration compactor, which has a vibration exciter comprising two parallel imbalance shafts located adjacent to one another and a drive unit for the imbalance shafts.

BACKGROUND OF THE INVENTION

Construction machines for soil compaction, or soil compaction machines, are used where an increase of the density of the soil is desired. This relates in particular to the compaction of asphalt, earth, gravel, sand, etc. This is regularly the case, for example, in roadway, path, and route construction, however, this list is in no way to be understood as restrictive. Soil compaction machines frequently comprise a vibration means for this purpose, via which load pulses which compact the soil can be introduced into the surface of the soil. Such a vibration means typically comprises a vibration exciter and a soil contact unit. In particular, vibratory plates having a plate as a soil contact unit and vibration rollers having a hollow-cylindrical roller drum as a soil contact unit can be described as examples of such vibration compactors, which are particularly preferred refinements of the present invention. Such vibration rollers can be self-propelled or manually guided. Specifically, this can relate in particular, for example, to so-called single-drum compactors or tandem rollers. The vibration exciters used in this case are especially developed for the application "compaction of the ground surface" and are optimally adapted to the design conditions and the intended use of construction machines for soil compaction. This relates, in particular, to the design of the vibration exciters usable here with regard to their operating variables, for example, vibration frequency, vibration amplitude, etc.

The vibration exciters used in such soil compaction machines are used to generate alternating load pulses for compacting soil, which are introduced into the soil via the respective soil contact. A vibration roller is known from EP 0704575 B1, in the roller drum of which a vibration exciter s installed which has two parallel imbalance shafts running in opposite directions. These are arranged in the roller drum opposite to one another in relation to the center axis of the roller drum and are connected to one another via a mechanical coupling in the form of a gear drive. The drive of the two imbalance shafts is performed via a motor, which acts on one of the imbalance shafts, while the other imbalance shaft is set into rotation via the gear drive. A vibratory plate and a manually-guided soil compaction roller are known, for example, from EP 2 743 402 A2.

Due to the parallel arrangement of the two imbalance shafts, it is possible to generate oriented vibrations, by changing the phase relation of the two imbalance shafts in relation to one another by means of an adjustment device. The change of the phase relation is performed by an adjustment of the angle position of one imbalance shaft relatively to the other imbalance shaft. For this purpose, for example, a hydraulic axially displaceable adjustment coil is provided on the relevant imbalance shaft, using which an axial control movement is converted into a rotational movement.

The present invention is based on the object of providing a soil compaction machine of the type described above, in which the vibration exciter enables a large number of exciter functions using relatively simple technical means.

This object is achieved in that the drive device of the vibration exciter has two motors, of which a first motor is operationally linked to the first imbalance shaft and a second motor is operationally linked to the second imbalance shaft.

SUMMARY OF THE INVENTION

The present invention has the advantage that no mechanical or hydraulic coupling is present between the two imbalance shafts, and instead each imbalance shaft can be activated independently via the associated motor. Therefore, both the rotational velocity and also the phase relation of each imbalance shaft can be set independently. The rotational velocity and the phase relation of each imbalance shaft can be changed individually. In addition to setting a positive or negative phase shift, the rotational directions of the two imbalance shafts can also be changed independently of one another. It is also possible to stop one of the two imbalance shafts while the other imbalance shaft rotates. A large number of exciter functions is enabled in this manner.

Electric or hydraulic motors are particularly suitable motors for the vibration exciter.

A variety of different operating modes with regard to vibration amplitude, vibration direction, and vibration type are fundamentally possible using the vibration exciter of the soil compaction machine according to the present invention. For example, the following operating modes can be executed using the vibration exciter of the soil compaction machine according to the present invention:

Operating mode 1: In operating mode 1, the first imbalance shaft runs at constant speed, while the second imbalance shaft is stationary or runs at most at half the speed of the first imbalance shaft. The result is a centrifugal amplitude, which revolves the vibration exciter circularly. Due to the substantially lower speed of the second imbalance shaft, its centrifugal force is so low that it has no noticeable influence on the movement behavior and in particular the exciter vibration of the entire vibration exciter. Since the centrifugal force is proportional to the square of the rotational velocity, the centrifugal force initiated by the second imbalance shaft or the imbalance mass arranged thereon corresponds to at most one-fourth of the centrifugal force of the first imbalance shaft. The slow rotation of the second imbalance shaft has the advantage that vibration bearings, in which the imbalance shafts are typically mounted, can build up a lubricant film and are thus not damaged by the vibration of the first imbalance shaft while stationary.

Operating mode 2: In operating mode 2, the first imbalance shaft runs at constant speed, while the second imbalance shaft follows in synchronous phase and with essentially identical speed in the same rotational direction, i.e., with the same sign of the rotational velocity. A centrifugal force amplitude which revolves circularly is thus created. The resulting amplitude is twice as high in this case as in operating mode 1.

Operating mode 3: In operating mode 3, the first imbalance shaft runs at constant speed, while the second imbalance shaft follows synchronously with the first imbalance shaft in the same rotational direction, i.e., with the same rotational velocity sign, but offset by a phase angle of 180°. Consequently, the centrifugal forces of the two imbalance shafts are precisely opposed during the entire operating time. Thus, no vibration movement results. If the two imbalance shafts are not arranged coaxially, but rather offset in parallel to one another, however, a changing oscillation torque results. This oscillation torque causes a rotational vibration of the vibration exciter.

Operating mode 4: In operating mode 4, the first imbalance shaft runs at constant speed, the second imbalance shaft runs in synchronous phase with the speed of the first imbalance shaft, but in the opposite direction. An oriented vibration (perpendicular to the plane of extension of the imbalance shafts) results, having the same maximum amplitude as in operating mode 2.

Operating mode 5: In operating mode 5, the first imbalance shaft runs at constant speed, while the second imbalance shaft runs synchronously with the first imbalance shaft, but in the opposite direction and with a phase rotated by 180°. An oriented vibration having the same maximum amplitude as in operating mode 4 results, the resulting vibration direction and in particular the vibration vector are rotated by 90°, however.

According to the present invention, in this case the drive device of the vibration exciter, being operationally linked to the two imbalance shafts, is implemented such that the rotational velocity of the first imbalance shaft and/or the rotational velocity of the second imbalance shaft is changeable between a positive and a negative rotational velocity. This switchover between a positive and a negative rotational velocity, the setting of a rotational velocity having the value equal to zero of course also being possible, thus enables a reversal of the rotation of the respective imbalance shaft, so that the two imbalance shafts can be set to run in the same direction, but also in opposite directions.

According to the present invention, any arbitrary intermediate setting between operating modes 4 and 5 can be set. In this case, a vibration oriented vertically to the ground enables a maximum compaction effect, wherein this compaction effect is successively reduced during a rotation of the vibration direction into the horizontal.

Any arbitrary other phase relation can also be set between the other operating modes described above. The effective compaction power can thus be adapted to the requirements. The resulting vibration is a combination in this case of circular (so-called non-oriented) vibration and oscillation.

In a special refinement, the first and the second motors of the vibration exciter have a first and a second drive shaft, respectively, which are operationally linked in each case via a gearing, in particular, a gear drive, to the first or the second imbalance shaft. In this manner, the position of the two imbalance shafts can be set very easily in conjunction with the respective motors, and a space-saving overall arrangement is obtained at the same time.

The first and the second drive shafts are preferably arranged coaxially to one another. In one embodiment, the two motors are additionally aligned on a shared axis, wherein they are preferably each arranged laterally to the two imbalance shafts extending in parallel. The drive shafts thus lie on a shared axis of symmetry, in relation to which the first and second imbalance shafts are arranged offset to the left and right in a plane. In this manner, the force transmission from the drive shaft to the respective associated imbalance shaft is can be implemented very simply by a gearwheel pair or similar gearing, wherein these gearwheels are arranged on the drive shaft and the respective imbalance shaft and mesh with one another.

The first and the second imbalance shafts are preferably arranged in relation to one another in the direction of their rotational axes such that the resulting centrifugal forces of the two imbalance shafts lie at least approximately in a shared plane. In the present context, "at least approximately in a shared plane" is to be understood as a deviation of the two planes by less than 100 millimeters, or a maximum of 5% of the total width in particular of the drum. In this manner, the loads acting on the vibration exciters are transferable very simply, in particular, in a vibration exciter housing.

The vibration exciter of the soil compaction machine according to the present invention preferably comprises at least one sensor device, which is implemented for detection of the angle position of the first and/or the second imbalance shaft. The angle position allows for direct conclusions to be drawn as to the present imbalance loads and in particular the direction thereof, wherein the sensor data are preferably transmitted to the positioning means, which can initiate appropriate steps for setting the respective operating mode therefrom and in particular can activate the respective motor in a specific manner. Thus, the phase relation can be concluded very easily as needed, for example, after the detection of the angle positions of the individual imbalance shafts and, if necessary, a phase adjustment can be performed. It is also possible to provide corresponding velocity sensors, which detect the velocity of the imbalance shafts either directly or via the angle position and the change thereof, and thus enable an inference about the respective operating modes.

In a further embodiment of the soil compaction machine, at least one auxiliary imbalance mass, which is rotatable about its axis of rotation, is arranged on the first imbalance shaft of the vibration exciter and/or at least one second auxiliary imbalance mass, which is rotatable about its axis of rotation, is arranged on the second imbalance shaft, wherein the first auxiliary imbalance mass is rotationally coupled via at least one first coupling element to the second imbalance shaft and the second auxiliary imbalance mass is rotationally coupled via at least one second coupling element to the first imbalance shaft, respectively. This means that during a rotation of the first imbalance shaft, the second auxiliary imbalance mass arranged on the second imbalance shaft also rotates in dependence on the first imbalance shaft, even if the second imbalance shaft is stationary. Vice versa, of course, the first auxiliary imbalance mass arranged on the first imbalance shaft rotates in dependence on the rotation of the second imbalance shaft.

The drive device assigned to the respective first and second imbalance shafts and, in particular, the respective first and second motors, thus drive further auxiliary imbalance masses, which are each arranged on the parallel shafts via suitable coupling elements. Such a design allows for easy setting of the vibration direction.

In this regard, at least one imbalance shaft and the auxiliary imbalance mass arranged thereon are preferably implemented such that the imbalance formed by at least one imbalance element of the imbalance shaft and the auxiliary imbalance formed by the auxiliary imbalance mass are of equal size. In such an embodiment, driving this one imbalance shaft is already sufficient to generate an oriented vibration. In this manner, a directional vibration can be generated by means of a single imbalance shaft.

The first and the second auxiliary imbalance masses are preferably implemented identically such that the auxiliary imbalances formed thereby on the respective imbalance shafts are of equal size. In particular, in conjunction with imbalance shafts which are also identical or are provided with identical imbalances, a vibration exciter having a very broad spectrum of settings and operating modes thus results.

The first coupling element preferably has at least one gearing element, comprising at least two gearwheels which are operationally linked to one another, in particular, meshing, namely a first drive gearwheel which is operationally linked to the first imbalance shaft, and at least one second output gearwheel, which is operationally linked to the second auxiliary imbalance mass, and/or the second coupling element has at least one gearing element, comprising at least two gearwheels which are operationally linked to one another and in particular meshing, namely a second drive gearwheel, which is operationally linked to the second imbalance shaft, and at least one first output gearwheel, which is operationally linked to the first auxiliary imbalance mass. A very simple and space-saving arrangement is achievable in this manner.

Of course, instead of the direct meshing between the two gearwheels, suitable similar or similarly acting gearing elements can be provided, which provide corresponding transmission ratios.

In a special embodiment, the first and/or the second auxiliary imbalance mass has at least one hollow cylinder shell, which is arranged on the associated imbalance shaft such that it at least partially encloses an imbalance element arranged thereon. The hollow cylinder shell can thus be mounted using its two U-legs on the imbalance shaft, for example, so that it rotates about the imbalance element of the imbalance shaft during a rotation. Instead of such a hollow cylinder shell, of course, the first and/or the second auxiliary imbalance mass can be implemented geometrically differently, wherein it is preferably always implemented so that it encloses the imbalance element arranged on the respective imbalance shaft or is arranged on the imbalance shaft so that it rotates around this imbalance element.

BRIEF DESCRIPTION OF THE DRAWINGS

The present invention will be described in greater detail hereafter on the basis of three exemplary embodiments, which are illustrated in the drawings. In the schematic figures.

The same reference numerals are used hereafter for identical and identically acting elements, wherein sometimes apostrophes are applied for differentiation.

DETAILED DESCRIPTION OF THE INVENTION

Figure 1A:
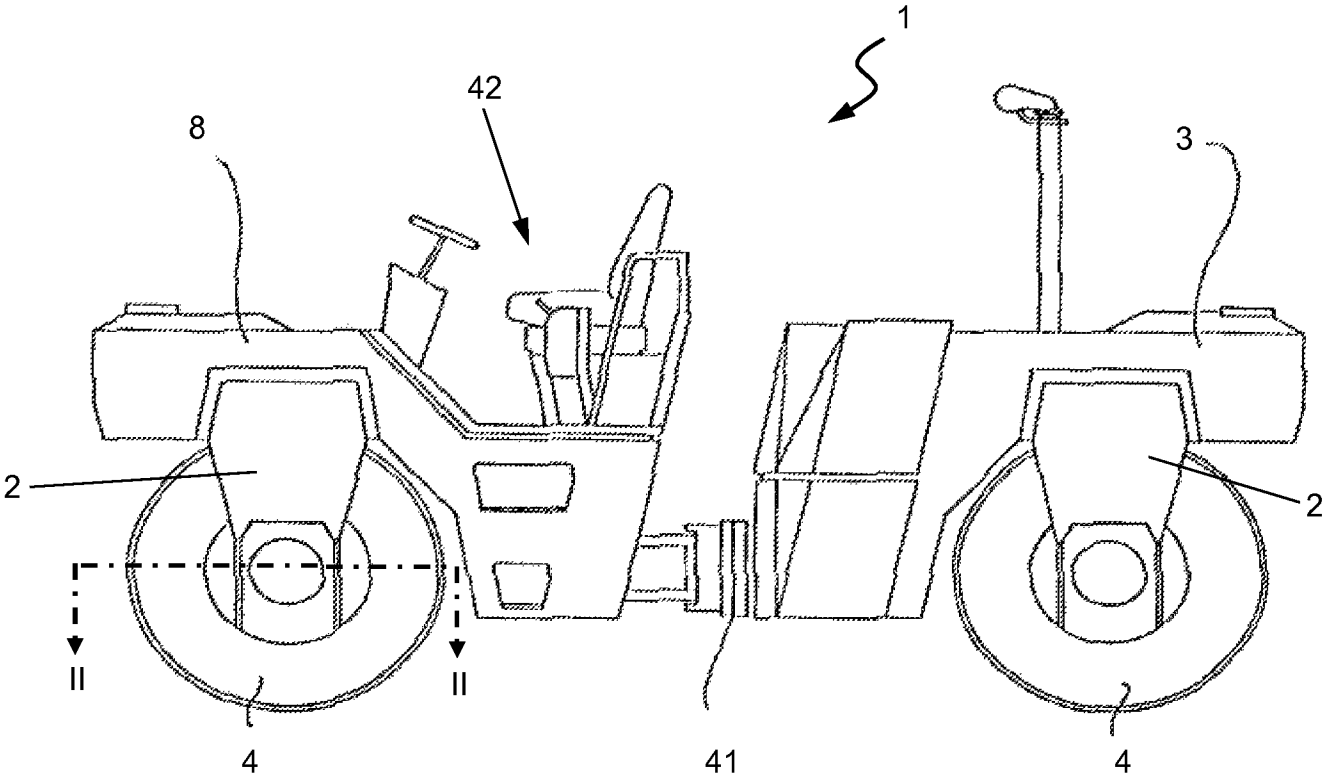
FIG. 1*a* shows a side view of an exemplary soil compaction machine of the type vibration roller.
Figure 1C:
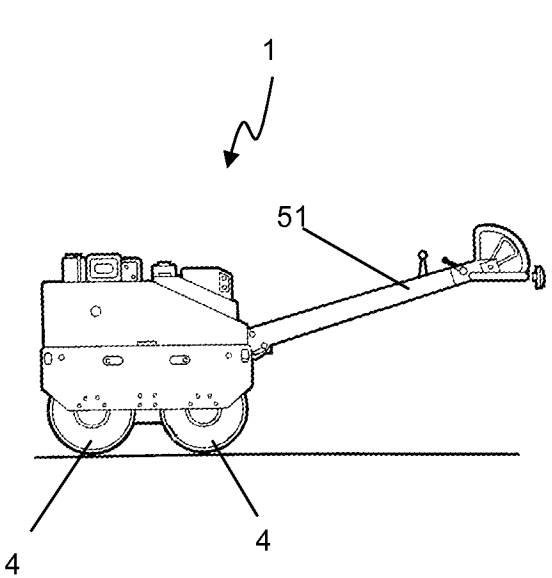
FIG. 1*c* shows a side view of an exemplary soil compaction machine of the type manually-guided vibration roller.
Figure 1B:
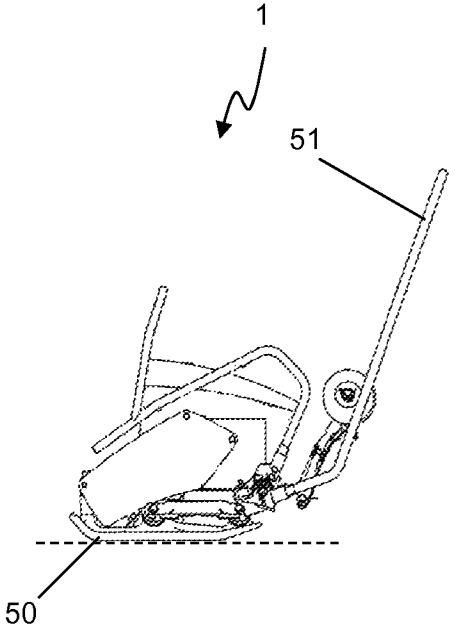
FIG. 1*b* shows a side view of an exemplary soil compaction machine of the type vibratory plate.

FIG. 1*a* shows a side view of a machine for soil compaction designed as a self-propelled vibration roller 1. The vibration roller 1 has a front carriage 8 having an operator's platform 42 and a rear carriage 3 having a diesel engine, which are connected via an articulated joint 41. A roller drum 4 (soil contact device) is arranged in each case on the front carriage 8 and on the rear carriage 3 via a roller drum support 2. At least one of the roller drums 4 is provided with a travel drive. Furthermore, the interior of each roller drum 4 is provided with a vibration exciter 6 (FIGS. 2, 3, 8), using which the roller drums 4 are set into vibration, which is transferred to the soil for the purpose of vibration compaction. FIG. 1*b* illustrates an example of the basic structure of a soil compaction machine of the type vibratory plate. Essential elements here are a drive motor, a compaction plate 50 (soil contact device) having a vibration exciter (not visible), and a guide bracket 51. FIG. 1*c* finally shows the basic structure of a soil compaction machine of the type manually-guided vibration roller, which in the present exemplary embodiment comprises two roller drums 4 having vibration exciters (not visible). Furthermore, a drive motor and also a guide bracket 51 are also provided here, using which an operator can direct the manually-guided vibration roller in working operation.

Figure 2:
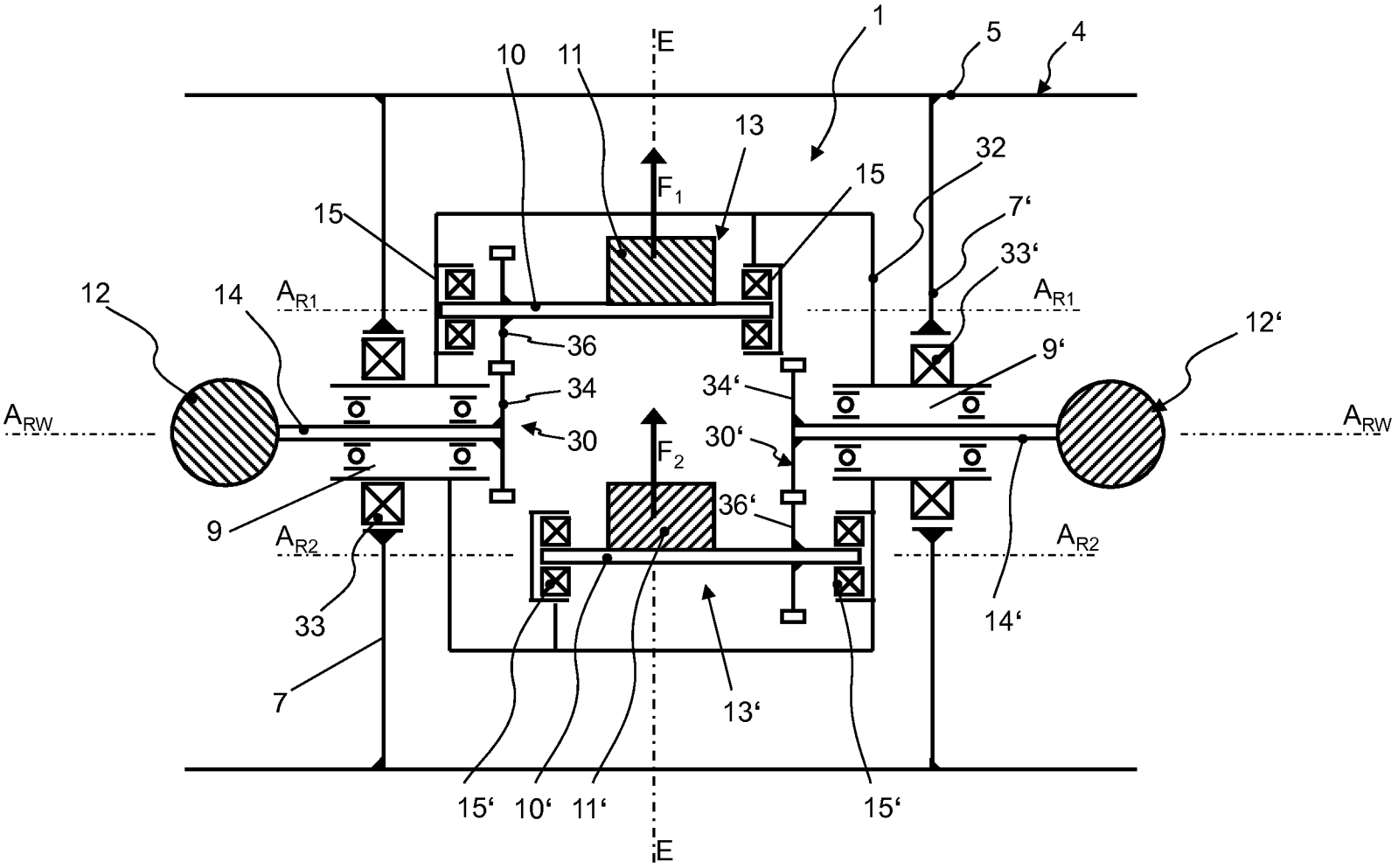
FIG. 2 shows a horizontal cross section along section line II-II in FIG. 1*a* through a first embodiment of a vibration exciter.

A first exemplary embodiment of a vibration exciter 6, as is provided in particular according to the present invention for one of the soil compaction machines shown in FIGS. 1*a* to 1*c*, is shown in FIG. 2. The vibration exciter 6 is implemented, with regard to its structural design and the operating parameters possible thereto, especially for use in a generic soil compaction machine, in particular, one according to FIGS. 1*a* to 1*c*. The roller drum 4 has a hollow cylinder 5 and a circular blank 7 on each end side, using which the roller drum 4 is rotatably mounted by means of bearings 33 on two axle stubs 9, 9'. The axle stubs 9, 9' are mounted on opposing roller drum supports 2 (not shown). Furthermore, a housing 32 of the vibration exciter 6 is arranged on the stub axles 9, 9' in the hollow interior space of the roller drum 4. The vibration exciter 6 has two identically constructed eccentric devices 13, 13' and a drive device, which consists of a first and a second motor 12, 12' for the first eccentric device 13 and the second eccentric device 13', respectively. The first and the second motors 12, 12' are independent, so that they can be actuated and controlled separately. In this manner, the first and the second eccentric devices 13, 13' can also be controlled and operated independently of one another. The first and second motors 12, 12' are implemented as hydraulic motors.

Each of the two eccentric devices 13, 13' has a first or second drive shaft 14, 14', which is driven by the first or second motor 12, 12', respectively, and also a first or second imbalance shaft 10, 10' having a first or second imbalance mass 11, 11', respectively, which extend parallel to one another and to the axis of rotation $A_{RW}$ of the roller drum 4. The two imbalance shafts 10, 10' lie opposite to one another with respect to the rotation axis $A_{RW}$ of the roller drum 4 and at an equal distance thereto.

Firstly, the first eccentric device 13 will be described hereafter. The first drive shaft 14 is connected to the first motor 12, arranged outside the hollow interior space of the roller drum 4 on the first end side of the roller drum, and attached to one of the roller drum supports 2. Within the first axle stub 9, the first drive shaft 14 is mounted so it is rotatable coaxially thereto and is guided from the outside into the interior of the housing 32. The first drive shaft 14 is connected via a first gearing made of a first gearwheel pair 34, 36 to the first imbalance shaft 10 and is mounted via bearings 15 on the housing 32. The first imbalance shaft 10 can be set into rotational movement about its rotation axis $A_{R1}$ by the first motor 12.

The second motor 12' of the second eccentric device 13' is connected to the second drive shaft 14' and is arranged on the associated roller drum support 2 (not shown), in a mirror inverted manner with respect to the first motor 12, in front of the second end side of the roller drum 4. Inside the associated second axle stub 9', the second drive shaft 14' is mounted so it is rotatable coaxially thereto and is guided from the outside into the interior of the housing 32. The second drive shaft 14' is connected via a second gearing made of a second gearwheel pair 34', 36' to the second imbalance shaft 10' and is mounted via bearings 15' on the housing 32. The second imbalance shaft 10' can be set into rotational movement about its rotation axis $A_{R2}$ by the second motor 12'.

The first and the second motors 12, 12' enable the rotational velocity of the respective associated imbalance shaft 10, 10', their rotational direction, and the phase relation to be set.

In the embodiment shown here, the imbalance masses 11, 11' of the imbalance shafts 10, 10' are of equal size, so that the resulting centrifugal forces $F_1$ and $F_2$ in the case of an identical rotational velocity are also of equal magnitude. The two imbalance shafts 10, 10' are arranged in relation to one another along their rotational axes $A_{R1}$ and $A_{R2}$ such that the resulting centrifugal forces $F_1$ and $F_2$ at least approximately act in a plane E which extends along the line illustrated in FIG. 2.

During a rotation of the two imbalance shafts 10, 10' via the respective associated motors 12, 12', operating modes 1 to 4, which were described above in detail, may be set very simply in spite of the very uncomplicated technical implementation of the vibration exciter 6.

For example, only the first imbalance shaft 10 can be actively driven via the first motor 12 or only the second imbalance shaft 10' can be actively driven via the second motor 12', while the respective other imbalance shaft is stopped. For example, if the first motor 12 is activated so that the first imbalance shaft 10 runs at a constant speed, while the second motor 12' is stationary or only rotates at most at half of the speed of the first motor 12, the resulting centrifugal force $F_1$ proportional to the first imbalance mass 11 and its rotational velocity result in a revolving exciter amplitude. Since the rotational velocity of the imbalance shafts 10, 10' has an exponential influence on the exciter amplitude, in such an operating mode, the slow rotation of the second imbalance shaft 10' is negligible. However, this slow rotation causes a lubrication of the bearing 33, which significantly lengthens the service life of the vibration exciter 6. The operating mode described here corresponds to operating mode 1 described above.

Figure 3:
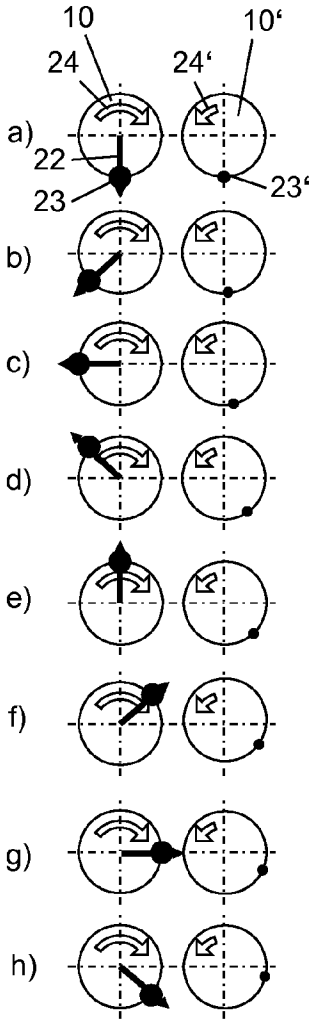
FIGS. 3 to 7 each show an illustration of various operating modes of the vibration exciter according to FIG. 2.

The magnitude and the direction of the resulting imbalance force of the vibration exciter 6 and the resulting torques according to operating mode 1 are illustrated in FIG. 3. For operating mode 1, in which the second imbalance shaft 10' rotates slowly, in FIG. 8, the resulting imbalance force and the resulting torque for the first and second imbalance shafts 10, 10' are illustrated in pairs in eight successive phase relations a) to h), which each differ by 45°. The direction of the imbalance force resulting in each phase relation is designated by arrow 22 and the different magnitudes of the imbalance forces on the first and second imbalance shafts 10 and 10', respectively, are identified with dots 23 and 23'. The rotational directions of the first and second imbalance shafts 10, 10' are identified with curved arrows 24 and 24', respectively, wherein different speeds are illustrated by different sizes of the curved arrows 24, 24'. To keep the illustration comprehensible, the reference signs are only indicated in the illustration of the first phase relation a).

Figure 4:
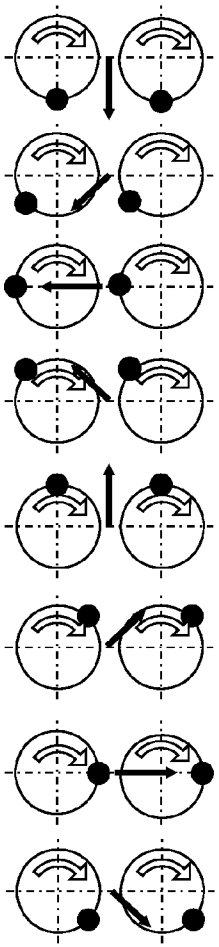

In operating mode 2, in contrast, both motors 12, 12' are operated at equal speed and in synchronous phase, so that a synchronous rotation of the imbalance shafts 10, 10' at equal rotational velocity and in particular at a rotational velocity having the same sign results. In this manner, an exciter vibration results which revolves circularly, its amplitude being twice as large as in above-described operating mode 1. The resulting centrifugal forces $F_1$ and $F_2$ add up here. Operating mode 2 is illustrated in FIG. 4, wherein identical reference signs are used for identical variables.

Figure 5:
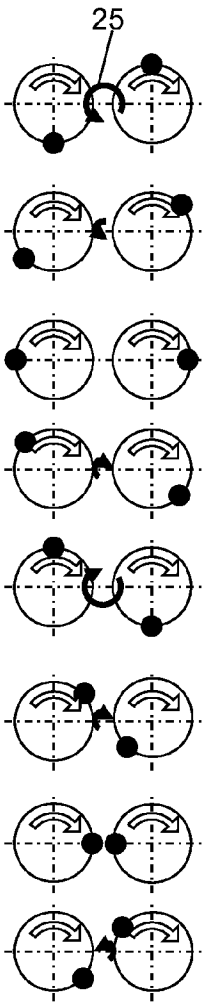

In contrast, if the phase of the first or the second motor 12, 12' is rotated by 180° at equal speeds of the first and second imbalance shafts 10, 10', the resulting centrifugal forces $F_1$ and $F_2$ of the two imbalance shafts 10, 10' extend in opposite directions during the rotation operation. An imbalance interference results and therefore no vibration amplitude. However, due to the distance of the two imbalance shafts from one another, an alternating oscillation torque results, which causes a rotational vibration of the vibration exciter. This operating mode is operating mode 3, which is shown in FIG. 5. In FIG. 5, the resulting torques are illustrated with a further curved arrow 25, which is of different sizes in accordance with the amount of the torque in the different phase relations.

Figure 6:
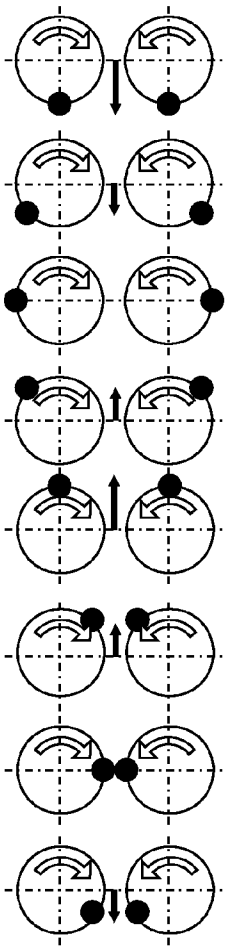
Figure 7:
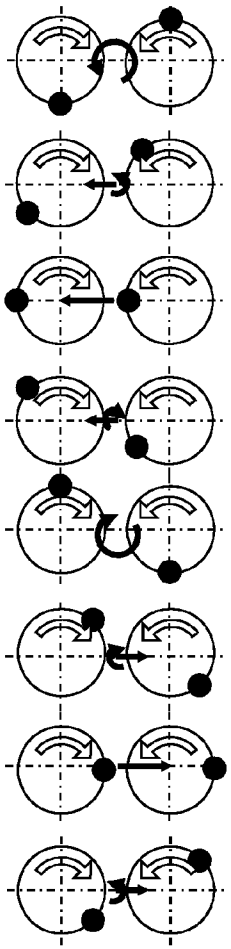

In operating mode 4, as also already described, the first motor 12 is operated at constant speed, while the second motor 12' is operated in synchronous phase and at a rotational velocity such that the imbalance shafts 10, 10' rotate in opposite directions. In this manner, in the embodiment shown here, a vertically oriented vibration results having the same maximum amplitude as has already occurred in operating mode 2. FIG. 6 illustrates operating mode 4.

Rotation of the phase of the motors 12, 12' by 180° results in a change of operating mode 4 into operating mode 5, generating an oriented vibration having the same maximum amplitude as in operating mode 4.

According to one aspect of the present invention, both a vector adjustment and also an amplitude adjustment of the exciter vibration can thus be carried out by appropriate activation of the two motors 12, 12'.

Figure 8:
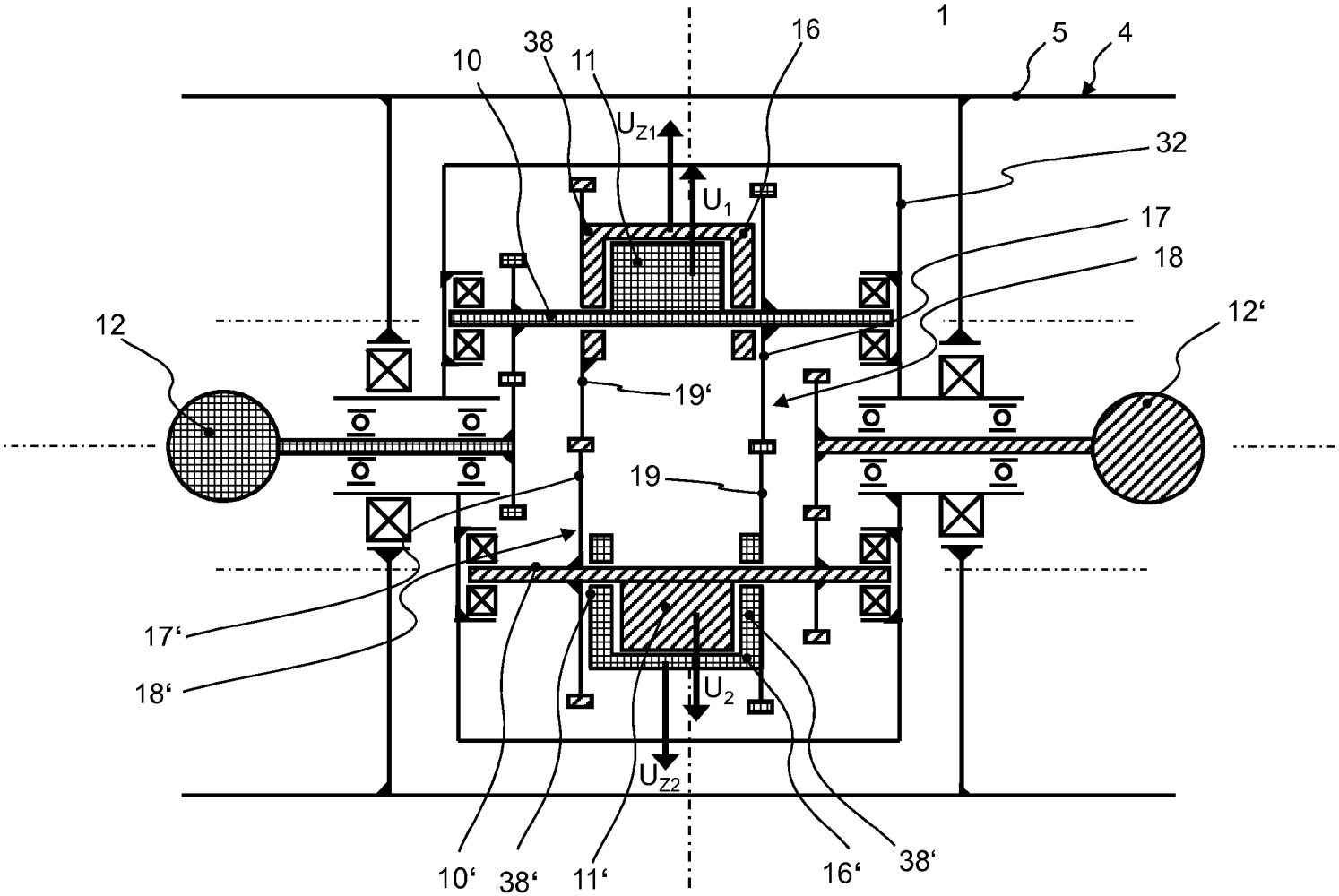
FIG. 8 shows a horizontal cross section along section line II-II in FIG. 1*a* through a second embodiment of a vibration exciter.

FIG. 8 shows a second exemplary embodiment of a vibration exciter 6' in a cross section as shown in FIG. 1. Compared to the first exemplary embodiment according to FIG. 2, the vibration exciter 6' shown here includes several additional components and setting capabilities. Identical parts are provided with identical reference signs. Reference is thus made to FIG. 2 for the description.

In addition, auxiliary imbalance masses 16, 16', specifically a first auxiliary imbalance mass 16 and a second auxiliary imbalance mass 16', are arranged on the imbalance shafts 10, 10'. These auxiliary imbalance masses 16, 16' are implemented here as hollow bodies in the form of sectors of hollow cylinder shells, which are mounted rotationally using legs 38 on the respective imbalance shaft 10, 10'. The auxiliary imbalance masses 16, 16' are shaped and arranged such that they can rotate about the first or second imbalance mass 11, 11', without obstructing a rotation of the first or second imbalance mass 11, 11', respectively.

The auxiliary imbalance masses 16, 16' are rotationally coupled crosswise with the imbalance shafts 10, 10'. This means that the first auxiliary imbalance mass 16, which is arranged on the first imbalance shaft 10, is connected to the second imbalance shaft 10'. The second auxiliary imbalance mass 16', which is mounted on the second imbalance shaft 10', is connected to the first imbalance shaft 10. During a rotation of the first imbalance shaft 10, in addition to the first imbalance element 11, the second auxiliary imbalance mass 16' also rotates. During a rotation of the second imbalance shaft 10', the first auxiliary imbalance mass 16 rotates together with the second imbalance mass 11'.

For this purpose, corresponding first or second mechanical coupling elements 18, 18' are provided, which transmit the respective rotational forces. The first coupling element 18 thus couples the first imbalance shaft 10 to the second auxiliary imbalance mass 16' and the second coupling element 18' couples the second imbalance shaft 10' to the first auxiliary imbalance mass 16. The respective coupling elements 18, 18' are again implemented here as a combination of drive gearwheels 17, 17' and output gearwheels 19, 19', which are meshed with one another.

In the embodiment illustrated here, the imbalance shafts 10, 10' driven by the motors 12, 12' thus drive, via the additional coupling elements 18, 18', the respective auxiliary imbalance masses 16, 16' arranged on the respectively other imbalance shaft 10, 10'. The imbalance masses 11, 11' and auxiliary imbalance masses 16, 16' which are arranged on each imbalance shaft 10, 10' are of equal size in this embodiment, so that the total imbalances resulting in each case from them on each imbalance shaft 10, 10' are of equal size. Thus, at equal rotational velocity, the imbalance mass 11 on the first imbalance shaft 10 causes equal imbalance $U_1$ (with regard to absolute value) as the first auxiliary imbalance mass 16 (imbalance $U_{Z1}$). Therefore, driving a single motor 12, 12' or one imbalance shaft 10, 10' is sufficient to generate an oriented vibration.

It is particularly advantageous to drive both motors 12, 12' at equal speeds such that the imbalance shafts 10, 10' rotate in opposite directions. The auxiliary imbalance masses 16, 16' thus also rotate at the same speed as the imbalance masses 11, 11' arranged fixedly on the imbalance shafts 10, 10'. The second auxiliary imbalance mass 16' thus rotates synchronously with the second imbalance mass 11'. Also, the first auxiliary imbalance mass 16 rotates identically with the first imbalance mass 11. The total imbalance can be changed by a change of the phase relation (here, the angle between the first auxiliary imbalance mass 16 and the first imbalance mass 11, or between the second auxiliary imbalance mass 16' and the second imbalance mass 11'). For particularly high speeds, for example, the total imbalance can be reduced to reduce loads on the vibration bearings.

In FIG. 8, the first imbalance mass 11 and the first auxiliary imbalance mass 16 are driven via the first motor 12. The second imbalance mass 11' and the second auxiliary imbalance mass 16' are driven by the second motor 12'. If both motors 12, 12' are driven at equal speed, depending on the phase relation of the imbalances, an oriented vibration having greater or smaller amplitude can be achieved. The greatest amplitude is defined by the following ratio:

$$\{(U_1+U_{Z1})+(U_2+U_{Z2})\},$$

and the smallest amplitude is defined by the ratio:

$$\{(U_1-U_{Z1})+(U_2-U_{Z2})\}.$$

If U and $U_Z$ are selected to be equal, the amplitude of the vibration can only be reduced to zero by changing the relative angle between the first motor 12 and the second motor 12'.

Two imbalances 11, 16 or 11', 16', whose relative positions can be changed in relation to one another, are thus located on each imbalance shaft 10, 10'. The imbalance can be set continuously from the maximum value down to zero. In the case of reduction of the imbalance, the bearings of the imbalance shafts 10, 10' are relieved, so that higher speeds of the imbalance shafts 10, 10' are possible. This is because the centrifugal forces of the individual imbalances $U_2$ and $U_{Z2}$ or $U_1$ and $U_{Z1}$ only act with their vector total on the associated bearing points. The mounting of the auxiliary imbalance masses 16, 16' on the imbalance shafts 10 or 10', respectively, is unproblematic, since only the adjustment movements are transmitted here. Independently of the vibration speed, only low relative velocities occur during a change of the phase relation.

In addition, a further operating mode is also possible using the second exemplary embodiment of the vibration exciter 6'. In this case, the motors 12, 12' are driven such that the imbalance shafts 10, 10' rotate in the same rotational direction and with the same sign of the respective rotational velocity. The first imbalance mass 11 thus rotates in the opposite direction to the first auxiliary imbalance mass 16 and the second imbalance mass 11' rotates in the opposite direction to the second auxiliary imbalance mass 16'. At equal drive speed of the motors 12, 12', an oriented vibration having constant vibration amplitude is generated. The vibration direction can be set freely by changing the phase relation between the motors 12, 12'.

Figure 9:
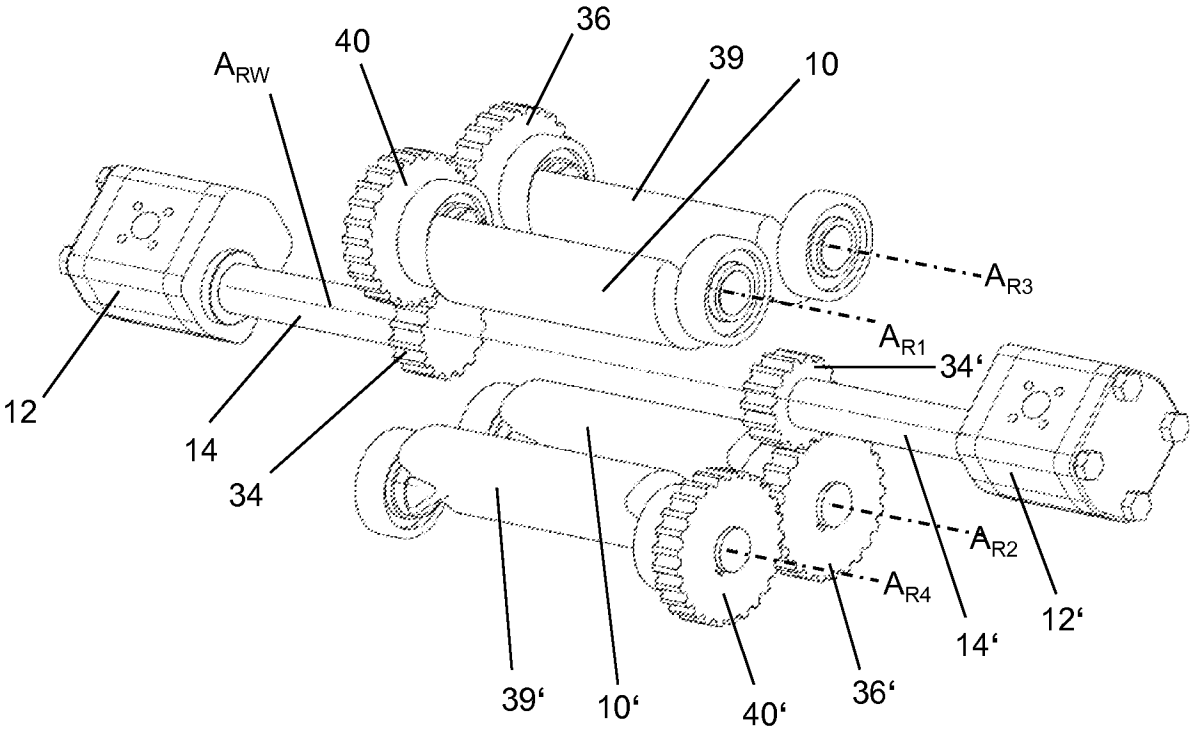
FIG. 9 shows a perspective view of a third exemplary embodiment of a vibration exciter.

In the third exemplary embodiment of the vibration exciter 6" according to FIG. 9, in each case a third or fourth imbalance shaft 39 or 39' is arranged in parallel to the first and second imbalance shafts 10, 10'. The first and third imbalance shafts (10, 39) are coupled via a mechanical gearing in the form of a gearwheel 40, which meshes with the gearwheel 36 on the first imbalance shaft 10. In the same way, the second imbalance shaft 10' is connected to the fourth imbalance shaft 39' via a gearwheel 40', which meshes with the gearwheel 36' on the second imbalance shaft 10'. In contrast to the first exemplary embodiment according to FIG. 1, instead of two independent imbalance shafts, two independent pairs of imbalance shafts are provided here, which are each driven by a separate motor 12, 12'.

The imbalance shafts 10, 39 or 10', 39' of each pair of imbalance shafts according to FIG. 9 are aligned such that the imbalance shafts of a pair revolve in phase. In addition, the third and fourth imbalance shafts 39, 39' are arranged at equal distance from the rotation axis $A_{RW}$ of the roller drum 4 and diametrically opposite to the rotation axis $A_{RW}$ of the roller drum 4. The planes defined by the rotational axes of each pair of imbalance shafts extend in parallel to one another. Accordingly, the rotation axis $A_{R1}$ of the first imbalance shaft 10 and the rotation axis $A_{R3}$ of the third imbalance shaft define a first plane, which extends in parallel to a plane which is defined by the rotation axis $A_{R2}$ of the second imbalance shaft 10' and the rotation axis $A_{R4}$ of the fourth imbalance shaft 39'.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A soil compaction machine, comprising a vibration exciter for generating a plurality of different exciter vibrations, the vibration exciter having first and second parallel imbalance shafts located adjacent to one another and a drive device for the first and second imbalance shafts, the first imbalance shaft having a first imbalance mass and the second imbalance shaft having a second imbalance mass, wherein the drive device has first and second independent motors, the first motor having a first drive shaft and the second motor having a second drive shaft, the first drive shaft being operationally linked to the first imbalance shaft via a gearing element and the second drive shaft being operationally linked to the second imbalance shaft via another gearing element.

2. The soil compaction machine according to claim 1, wherein the first and the second drive shafts are arranged coaxially to one another.

3. The soil compaction machine according to claim 1, wherein the first and the second imbalance shafts are arranged in relation to one another in the direction of their rotational axes ($A_{R1}$, $A_{R2}$) such that resulting centrifugal forces ($F_1$, $F_2$) of the two imbalance shafts at least approximately lie in a shared plane (E).

4. The soil compaction machine according to claim 1, wherein at least one first auxiliary imbalance mass rotatable about its rotational axis ($A_{R1}$) is arranged on the first imbalance shaft and/or at least one second auxiliary imbalance mass rotatable about its rotational axis ($A_{R2}$) is arranged on the second imbalance shaft, wherein the first auxiliary imbalance mass is rotationally coupled via at least one first coupling element to the second imbalance shaft and the second auxiliary imbalance mass is rotationally coupled via at least one second coupling element to the first imbalance shaft, respectively.

5. The soil compaction machine according to claim 4, wherein at least one imbalance shaft and the auxiliary imbalance mass arranged thereon are implemented such that the imbalance (U1, U2) formed by at least one imbalance mass of the imbalance shaft and the auxiliary imbalance ($U_{Z1}$, $U_{Z2}$) formed by the auxiliary imbalance mass are of equal size.

6. The soil compaction machine according to claim 5, wherein the first and the second auxiliary imbalance masses are implemented identically such that the auxiliary imbalances ($U_{Z1}$, $U_{Z2}$) formed thereby on the respective imbalance shafts are of equal size.

7. The soil compaction machine according to claim 4, wherein the first coupling element has at least one gearing element, having at least two gearwheels which are operationally linked to one another, comprising a first drive gearwheel which is operationally linked to the first imbalance shaft and at least one second output gearwheel which is operationally linked to the second auxiliary imbalance mass, and/or the second coupling element has at least one gearing element, having at least two gearwheels which are operationally linked to one another, comprising a second drive gearwheel which is operationally linked to the second imbalance shaft and at least one first output gearwheel which is operationally linked to the first auxiliary imbalance mass.

8. The soil compaction machine according to claim 4, wherein the first and/or the second auxiliary imbalance mass comprises at least one hollow cylinder shell which is arranged on the associated imbalance shaft such that it at least partially encloses an imbalance mass arranged thereon.

9. The soil compaction machine of claim 1, wherein the soil compaction machine comprises a vibration compactor.

* * * * *